US005368534A

United States Patent [19]

Gerenz

[11] Patent Number: 5,368,534

[45] Date of Patent: Nov. 29, 1994

[54] EXERCISER SYSTEM AND METHOD FOR PROVIDING COORDINATED BODY WORKOUT

[76] Inventor: Peter Gerenz, 30 Angle St., #1, Lowell, Mass. 01851

[21] Appl. No.: 221,094

[22] Filed: Mar. 31, 1994

[51] Int. Cl.[5] ..... A63B 69/06

[52] U.S. Cl. ..... 482/72; 482/142

[58] Field of Search ..... 482/57, 72, 73, 51, 482/91, 95, 96, 110, 907, 142

[56] References Cited

U.S. PATENT DOCUMENTS

| | | | |
|---|---|---|---|
| 3,792,860 | 2/1974 | Selnes | 482/72 |
| 4,687,197 | 8/1987 | Larsson et al. | 482/73 |
| 4,943,051 | 7/1990 | Haskins et al. | 482/72 |
| 4,976,423 | 12/1990 | Routti | 482/73 |

*Primary Examiner*—Stephen R. Crow

*Attorney, Agent, or Firm*—Daniel J. Bourque; Anthony G. M. Davis; Michael G. Bujold

[57] ABSTRACT

A coordinated movement exercise apparatus which provides coordinated and resistive exercise to a user includes a base section to which are coupled first and second pivotable members connected diagonally by a connecting member. The first and second pivotable members and the connecting member combine to form a "Z" shaped exerciser section which insured coordinated exercise movement by the user. At least one resistive member is coupled between the connecting member and one of the first and second pivotable members to provide resistance to motion when in use by the user. A seat is also included on the exercise apparatus as well as hand and foot gripping or engaging members.

5 Claims, 3 Drawing Sheets

EXERCISER SYSTEM AND METHOD FOR PROVIDING COORDINATED BODY WORKOUT

FIELD OF THE INVENTION

This invention relates to exerciser systems and more particularly, to an exerciser machine and method of using same which coordinates body movements during exercise to facilitate body workout.

BACKGROUND OF THE INVENTION

Recent interest in good health and fitness has resulted in a proliferation of exercise equipment and methods in the hopes of attracting users to purchase and use such equipment. Most, if not all, of the prior art exercise systems, however, have numerous severe draw backs which inhibit or discourage the user from utilizing the system once purchased.

For example, most prior art exercise systems are large and heavy, and unsuited for the many small apartments or condominiums inhabited by today's health conscious individuals. Users do not wish to constantly have a large exercise system in their home when the system is not in use.

Additionally, and most importantly, these prior art exercise systems do not allow for their use in a manner that is "natural" to the body's normal movements which occur during such activities as walking or running. Accordingly, users of the prior art systems soon discover that utilizing these apparatus forces them to adopt an exercise method or regimen which is unnatural to the body, or unsynchronized with the body's normal movements and thus, use of these prior art exercise machines rapidly diminishes after they are purchased.

Accordingly, what is needed is a compact and inexpensive exercise apparatus and a method for utilizing the same which provides for and allows the body to move in a natural synchronized manner, and which thus encourages users to utilize the system to achieve their intended goal of a total body workout with its resultant improved health and fitness.

SUMMARY OF THE INVENTION

This invention features an exercise apparatus which provides coordinated and resistive exercise to a user by providing an apparatus which coordinates the hand and arm movement as well as foot and leg movement to provide the user with a natural and rhythmic arm and leg coordinated exercise.

The invention features an apparatus which includes a base section having first and second end regions. A seat is provided on the base section proximate the first end region. The device further includes first and second pivotable cross members each having first and second ends.

The first pivotable cross-member is pivotably coupled proximate a central region of the cross-member, which is approximately mid-way between the first and second ends, to the base section proximate the second end region. The second pivotable cross-member is also coupled proximate its central region, which is approximately mid-way between its first and second ends to the base member proximate the seat and parallel to the first pivotable cross-member, such that the first end of the second pivotable cross-member is opposite the first end of the first pivotable cross-member, while the second end of the first pivotable cross-member is similarly disposed opposite the second end of the second pivotable cross-member.

The invention further includes a connecting member, having first and second ends, which is coupled to the first and second pivotable cross-members. The first end of the connecting member is pivotably coupled proximate one of the first and second ends of the first pivotable cross-member, while the second end of the connecting member is pivotably coupled proximate one of the first and second ends of the second pivotable cross-member, such that the connecting member is disposed diagonally relative to the first and second pivotable cross-members so as to combine with the first and second pivotable members to form an exercise section of the exercise apparatus which has a generally "Z" shaped form.

The connecting member is operative for coordinating and controlling the movement of the first pivotable member relative to the second pivotable member such that as the first end of one of the first and second pivotable members is moved and displaced in a first direction, the first end of the other of the first and second pivotable member is moved and displaced in a second direction opposite to that of the first direction.

The invention further includes at least one motion resistive element, such as a piston or shock absorber, which is coupled between one of the first and second pivotable members and the connecting member, for providing resistance to movement and displacement of the first and second pivotable cross-members by the user.

In the preferred embodiment, the first pivotable cross-member includes means for engaging the cross-member with the feet of the user, such as foot pedals. These pedals may include straps or other similar devices to ensure that the pedals stay engaged with the feet of the user. Also included in the preferred embodiment are means for engaging the second pivotable cross-member with the hands of the user. Such means preferably include handles which are removable coupled to the second pivotable cross-member when in use, and may be disengaged or folded down from the exerciser when not in use.

In the preferred embodiment, the connecting member is pivotably coupled directly to the first and second pivotable cross-members. In this embodiment, one motion resistive element is provided between one of the first and second pivotable cross-members and connecting member. In a second embodiment, the connecting member is indirectly coupled to the first and second pivotable cross-members by means of first and second motion resistive elements coupled between the first and second pivotable cross-members and the first and second ends of the connecting member respectively.

The present invention thus features a low profile, lightweight and low cost exercise apparatus which may be easily folded down or partially disassembled for storage in a small area such as under a bed or in a closet, yet which provides coordinated and resistive exercise to the user.

The base section 12*a* of the present invention further includes 3 support feet or legs 104 (only 2 shown) which support and stabilize the exerciser when in use.

Accordingly, a low cost, lightweight, coordinated resistive movement exercising apparatus has been provided which is compact and can be partially disassembled for storage in a closely confined environment, yet which provides for coordinated exercise to the user, thus encourage and facilitating use of the exercise apparatus.

BRIEF DESCRIPTION OF THE DRAWINGS

These, and other features and advantages of the present invention would be better understood by reading the following detailed description taken together with the drawings wherein.

DETAILED DESCRIPTION OF THE INVENTION

Figure 1:
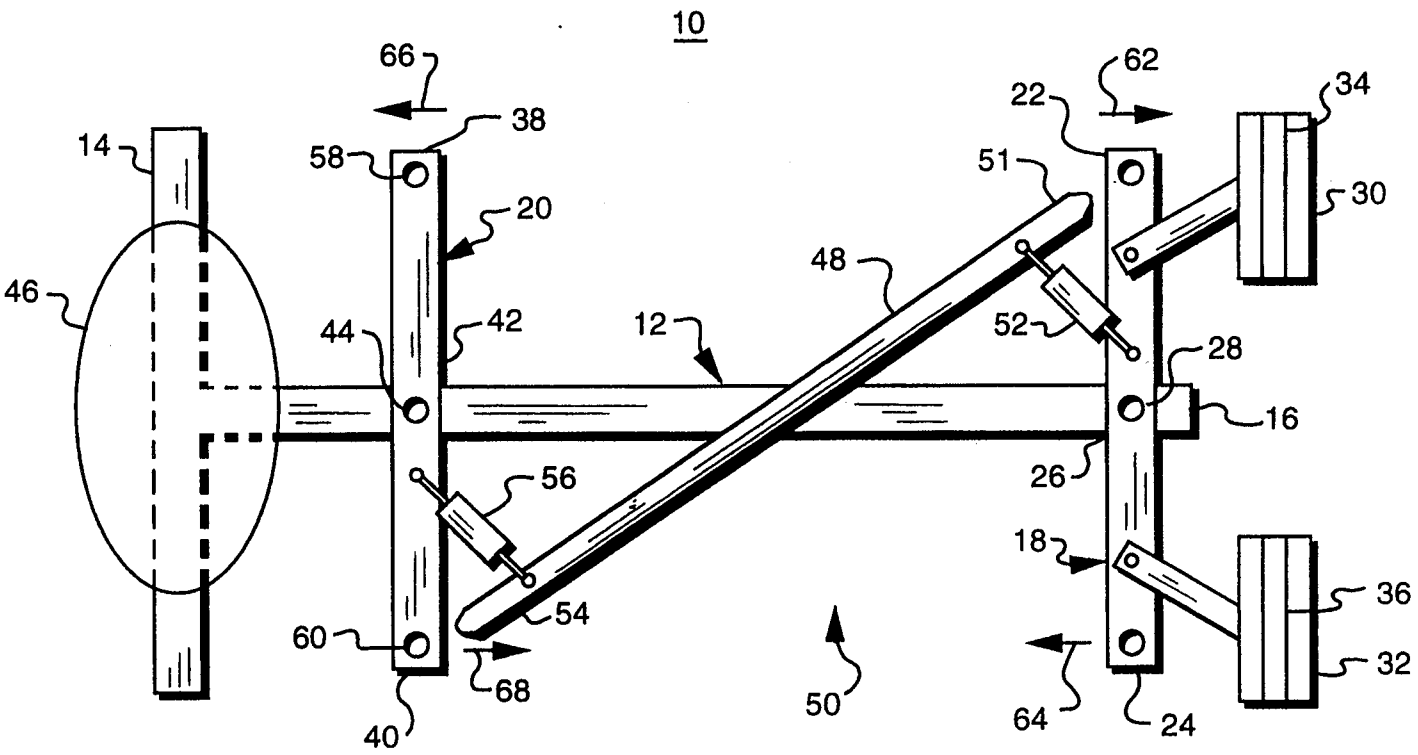
FIG. 1 is a schematic top view of a first embodiment of the present invention.

The exercise apparatus of the present invention is shown generally at 10, FIG. 1 and includes a base section 12 having a first end region 14 in the shape of a "T", and a second base region 16.

Coupled to the base section 12 are first and second pivotable cross-members 18 and 20. A first pivotable cross-member 18 includes first and second ends 22, 24 and a central region 26, which is approximately midway between the first and second ends 22, 24. The first pivotable cross-member 18 is coupled to the base section 12 proximate the second end region 16 at or about the central region 26 of the first pivotable cross-member. The first pivotable cross-member 18 is pivotably coupled to the base section 12 by means of a fastening device 28 such as a bolt, which couples the first pivotable cross-member to the base section, yet allows for rotational movement of the pivotable cross-member about an axis which passes through a fastening device 28.

The first pivotable cross-member 18 also preferably includes first and second foot rests or foot pedals 30, 32 which provide a location on which the user may place their feet to use the exercise apparatus. The foot rests 30, 32 may also optionally include coupling straps 34, 36 which serve to securely fasten or couple the user's feet to the foot pedals.

Also pivotably coupled to the base section 12 is a second pivotable cross-member 20 having first and second ends 38, 40. The second pivotable cross-member 20 also includes a central region 42 at which the second pivotable cross-member 20 is coupled to the base section 12 also by means of fastener 44. The second pivotable cross-member 20 is located near or proximate seat 46 which is coupled to the base section 12 proximate the first end region 14.

The present exercise apparatus further includes a connecting member 48 which is coupled to diagonally opposing ends of the first and second pivotable cross-members 18, 20, to form a generally "Z" shaped exerciser section 50 of the exerciser apparatus 10.

In this embodiment, connecting member 48 is indirectly coupled proximate the first end 22 of the first pivotable cross-member 18 by means of a first motion resistive element 52, which in this embodiment is a piston of shock absorber type of element.

The connecting member 48 is also coupled proximate its' second end 54 to the second end 40 of the second pivotable cross-member 20 by means of a second motion resistive element 56 which is also a piston or shock absorbing type of device. Alternatives to the first and second motion resistive elements 52, 56 include fluid, springs or other similar devices.

Although not shown in this embodiment, the preferred embodiment contemplates that the second pivotable cross-member 20 include first and second removable hand gripping members such as handles which rise generally vertically from the exerciser section 50 as indicated generally at locations 58 and 60. The handles allow the user to grip the exerciser during use.

A feature of the present exercise apparatus is the coordination and synchronization of hand and arm versus leg and foot movement. Thus, when in use, the user applies a force to the exerciser section to a first of either end of the first pivotable cross-member 18 through foot pedals 30, 32 in the direction indicated generally by arrows 62 and 64. The user may simultaneously or alternatively apply a force in the opposite direction indicated generally by arrows 66 and 68 to the other end of the first pivotable cross-member. The connecting member 48 insures that when a force is applied to one side of the exerciser, such as to second end 24 or 40 of the first or second pivotable cross-member 18, 20 as indicated for example by arrow 68, connecting member 48 will cause the second end 24 of the pivotable cross-member 18 to move in an opposite direction as shown generally by arrow 64.

During this time, the first ends 22 and 38 of the first and second pivotable cross-members 18, 20 respectively, will move as indicated generally by arrows 62 and 66. During a second phase of user applied force, the user will apply a force as indicated generally by arrows 62 and 66 to the second ends 24 and 40 of the first and second pivotable members, which will cause the first ends 22, 38 to move inwardly toward one another as shown and previously described in conjunction with arrows 64 and 68.

Thus, connecting member 48 insures that the exercise apparatus will provide coordinated movement and exercise to the user by maintaining the inward and outward relationship of the user's left leg and left arm and right leg and right arm. Accordingly, a user need not be concerned with achieving a coordinated movement, but instead, such coordinated movement is assured and controlled by the apparatus of the present invention.

Figure 2:
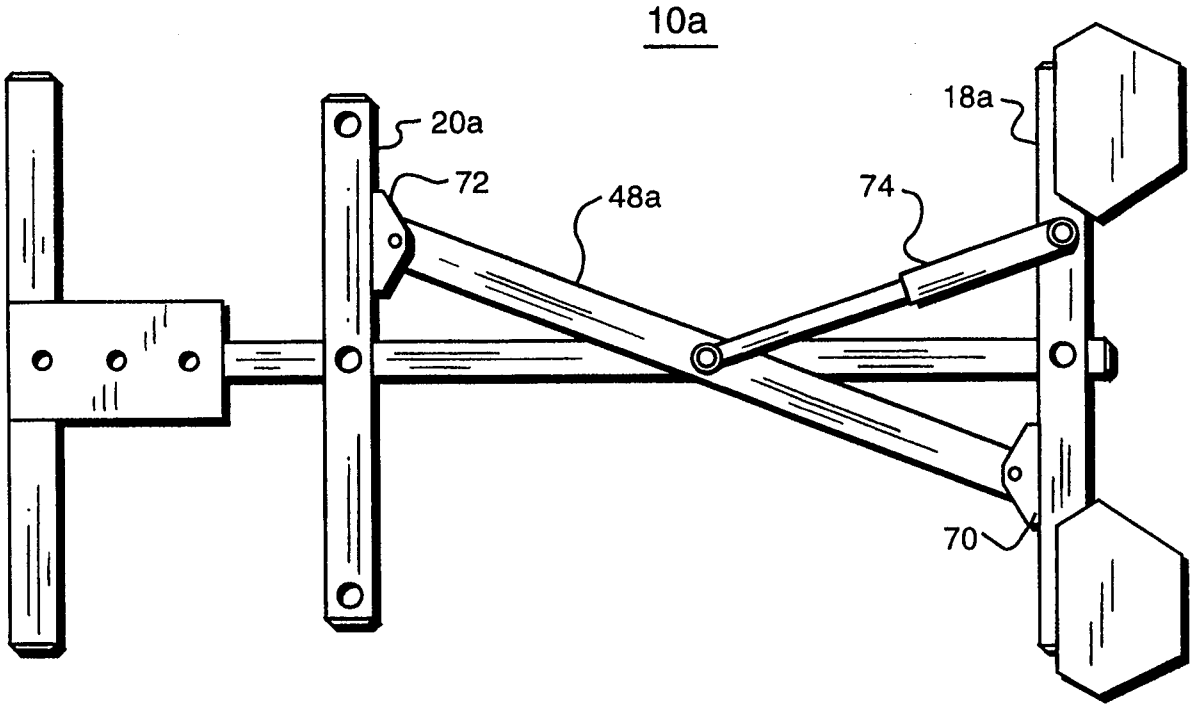
FIG. 2 is a schematic top view of a second embodiment of the present invention.

In a second embodiment illustrated in FIG. 2, the present exercising apparatus **10*a* includes a connecting member 48*a* which is directly coupled to the first and second pivotable cross-members 18*a* and 20*a* by means of pivotable couplings 70 and 72. In this embodiment, only one motion resistive element 74** which is illustrated as a piston or shock absorber is required.

Figure 3:
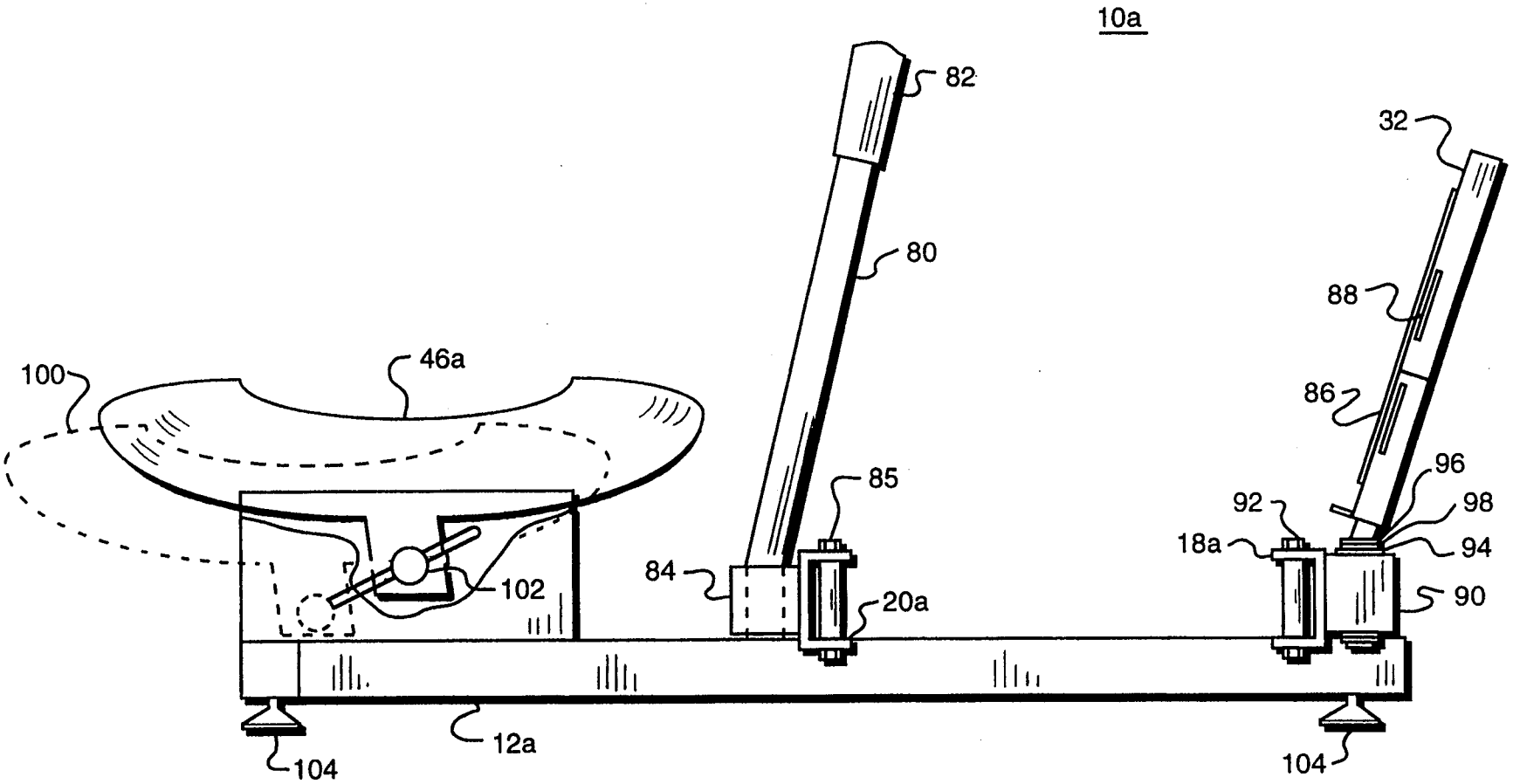
FIG. 3 is a side view of the exerciser of FIG. 2.

As shown in a side view in FIG. 3, the second embodiment of the exerciser apparatus **10*a* includes first and second handles 80 (only one shown) which may include a foam or other soft grip 82 which may be grasped by the user. Handles 80 are removably inserted into handle receiver bracket 84 which are coupled to the second pivotable cross-member 20*a* by means of bolt 85. In this embodiment, the second pivotable cross-member 20*a*** is illustrated as a U shaped member although a box shaped member may also be utilized. The pivotable cross-members, the connecting member and the base section of the present invention may be fabricated from any suitable material such as steel, aluminum or even impact resistant plastic to provide for a lightweight exercising apparatus.

The foot pedals, such as foot pedal 32, may include a foot rest region 86 against which the user's foot rests, as well as a foot strap 88 which serves to securely attach the user's foot to the foot pedal 32. As in the case of handle 80, foot pedal 32 is removably inserted into support bracket 90 which is coupled to the first pivotable cross-member 18*a* by means of bolt 92. In this embodiment, the retaining bracket 90 also includes a bearing 94 held in place by a retaining ring 96 proximate a washer 98.

In this embodiment, the user's seat 46*a* is adjustable to various positions as shown by dash line 100 utilizing an adjustment knob 102. Adjustability of the seat allows various users to adjust the seat to conform to the user's height and preferred posture for exercising.

Modifications and substitutions by one of ordinary skill in the art are considered within the scope of the present invention, which is not to be limited except by the claims which follow.

I claim:

1. An exercise apparatus for providing coordinated resistive exercise to a user, comprising:

a base section having first and second end regions;

a seat coupled to said base section proximate said first end region;

a first pivotable cross-member having first and second ends, said first pivotable cross-member also including a central region approximately mid-way between said first and second ends, said first pivotable cross-member pivotably coupled proximate its' central region to said base section proximate said second end region of said base section, said first pivotable cross-member including first and second foot engaging devices;

a second pivotable cross-member having first and second ends, said second pivotable cross-member also including a central region approximately mid-way between said first and second ends, said second pivotable cross-member pivotably coupled proximate its' central region to said base section proximate said seat and parallel to said first pivotable cross-member, such that said first end of said first pivotable cross-member is disposed opposite said first end of said second pivotable cross-member, and said second end of said first pivotable cross-member is disposed opposite said second end of said second pivotable cross-member, said second pivotable cross-member including first and second hand engaging devices;

a connecting member having first and second ends, and coupled to said first and second pivotable cross-members, said first end of said connecting member pivotably coupled proximate one of said first and second ends of said first pivotable cross-member, and said second end of said connecting member pivotably coupled proximate one of said first and second ends of said second pivotable cross-member, said one of said first and second ends of said first pivotable cross-member diagonally opposed from said one of said first and second ends of said second pivotable cross-member, such that said first pivotable cross-member, said connecting member, and said second pivotable cross-member combine to form a coordinated movement exercise section of said exercise apparatus, said coordinated movement exercise section having a generally "Z" shaped form, said connecting member operative for coordinating and controlling the movement of said first pivotable cross-member relative to said second pivotable cross-member such that when said first end of one of said first and second pivotable cross-members is moved and displaced in a first direction, said first end of the other of said first and second pivotable cross-member is moved and displaced in a second direction, opposite to said first direction; and at least one motion resistive element, coupled between one of said first and second pivotable cross-members and said connecting member, for providing resistance to movement and displacement of said first and second pivotable members relative to said connecting member by said user.

2. The exercise apparatus of claim 1, wherein said first foot engaging device is coupled proximate said first end of said first pivotable member, and said second foot engaging device is coupled proximate said second end of said first pivotable member, for allowing first and second feet of said user to engage with said exercise apparatus; and said first hand engaging device is coupled proximate said first end of said second pivotable cross-member, and said second hand engaging device is coupled proximate said second end of said second pivotable member, for allowing first and second hands of said user to engage with said exercise apparatus.

3. The exercise apparatus of claim 1, wherein said at least one motion resistive element includes a piston.

4. The exercise apparatus of claim 1 further including a second motion resistive element, coupled between the other of said first and second pivotable member and said pivotable cross-member and said connecting member; and wherein said first and second motion resistive elements pivotably couple said connecting member to said first and second pivotable cross-members.

5. The exercise apparatus of claim 4, wherein said first and second motion resistive elements include first and second pistons.

* * * * *